US005323851A

United States Patent [19]

Abraham

[11] Patent Number: 5,323,851

[45] Date of Patent: Jun. 28, 1994

[54] PARALLEL FLOW CONDENSER WITH PERFORATED WEBS

[75] Inventor: Anthony W. Abraham, Arlington, Tex.

[73] Assignee: Wynn's Climate Systems, Inc., Ft. Worth, Tex.

[21] Appl. No.: 51,088

[22] Filed: Apr. 21, 1993

[51] Int. Cl.[5] ..... F28F 13/08

[52] U.S. Cl. ..... 165/174; 165/185

[58] Field of Search ..... 165/172, 174, 177, 183

[56] References Cited

U.S. PATENT DOCUMENTS 3,067,818 12/1962 Ware et al. ..... 165/174

4,602,682 7/1986 Yamamoto et al. ..... 165/174

5,246,064 9/1993 Hosbino et al. ..... 165/174 X

*Primary Examiner*—John C. Fox

*Attorney, Agent, or Firm*—James E. Bradley

[57] ABSTRACT

A parallel flow heat exchanger has perforated webs within its tubes. The tubes are parallel to each other and extend between headers. Each tube has webs located within it which define flow passages. The webs are perforated along the length to communicate refrigerant flow in one passage with that of refrigerant flow in other passages. The flow tubes are extruded integrally. The perforations are formed by air jets mounted in the extrusion die cores.

11 Claims, 3 Drawing Sheets

PARALLEL FLOW CONDENSER WITH PERFORATED WEBS

BACKGROUND OF THE INVENTION

1. Field of the Invention

This invention relates in general to air conditioners for use on motor vehicles, and in particular to a type having parallel flat tubes, the tubes having internal webs which are perforated to enhance heat transfer.

2. Description of the Prior Art

Parallel flow condensers are becoming more commonly used with air conditioning systems of motor vehicles. In a parallel flow condenser, two headers are spaced apart from each other, one of the headers having an inlet for vapor, and the other having an outlet for condensate. Flat parallel tubes extend between the headers. One or more baffles or partitions locate in the headers for o directing refrigerant flow through the parallel tubes between the headers. Fins are positioned between the parallel flow tubes to enhance heat transfer as air moves across.

The parallel tubes have webs within them, defining separate flow passages extending along the length of the tube. The webs may be extruded with the walls of the tube. In another technique, the web is inserted into the tube and brazed in place. The flow passages are quite small, and the pressures within the flow passages can be fairly high.

The heat exchange is not uniform across the tube from the front or leading edge to the back or trailing edge. Air moving across the tube strikes the front edge first and is warmed a it proceeds to the trailing edge of each tube. Consequently, more heat exchange can take place in the flow passages near the front edge than near the back edge.

SUMMARY OF THE INVENTION

In this invention, the parallel flow tubes have web walls located between, defining flow passages. However, the flow passages are not discrete from each other. Perforations are formed in the web walls along the length of the tube. These perforations allow refrigerant flow to pass from one flow passage to another flow passage. This increases turbulence and enhances fluid transfer. The web walls serve only to provide structural strength to the tube.

In the preferred embodiment, the web walls are formed integrally with the tube in an extrusion process. A core in the extrusion die forms each passage. The cores are spaced apart from each other to define the web walls. Some of the cores have air passages extending through them, with a lateral portion leading to one or both sides of the core. Air pulses are applied to the air passage. The air pulses result in a perforation or an aperture as they pulse against the molten metal being extruded around the cores through the die.

DETAILED DESCRIPTION OF THE INVENTION

Figure 1:
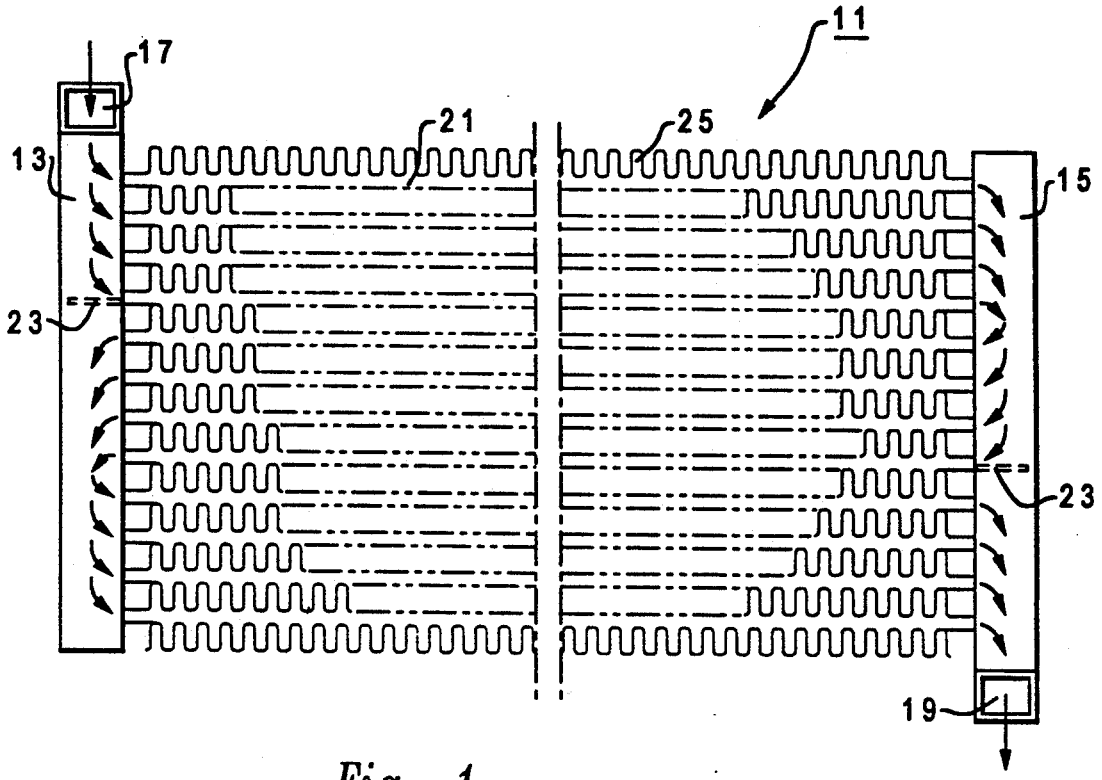
FIG. 1 is a schematic side elevational view of a condenser constructed in accordance with this invention.

Referring to FIG. 1, condenser 11 has a pair of spaced apart headers 13, 15. Headers 13, 15 are tubular members, and may be cylindrical or rectangular. Header 13 has an inlet for receiving vapor, the inlet being preferably located at the upper end of header 13. An s outlet 19, preferably located at the lower end of header 15, discharges condensed refrigerant liquid.

A plurality of tubes 21 extend between headers 13, each tube 21 being in fluid communication with headers 13, 15. Baffles or partitions 23 are positioned in headers 13, 15 to direct the flow of fluid to different groups of the tubes 21 as indicated by the arrows. A row of fins 25 extends between each of the tubes 21 to enhance heat exchange with air moving through the condenser 11.

Figure 2:
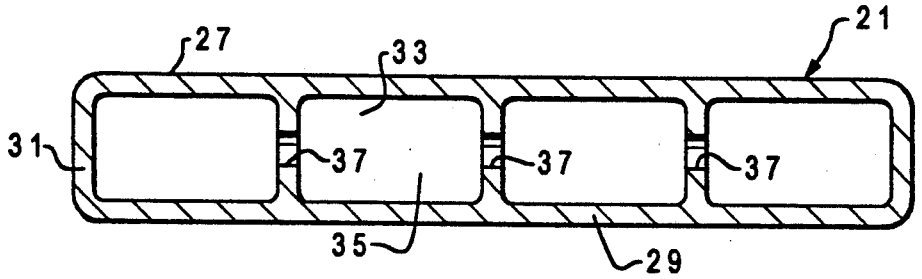
FIG. 2 is an enlarged sectional view of one of the tubes used with the condenser of FIG. 1.

Referring to FIG. 2, each tube 21 is substantially flat. Each tube 21 has an upper wall 27 and a lower wall 29 which are parallel with each other. Edge walls 31 located at opposite sides join upper wall 27 to lower wall 29. Edge walls 31 are perpendicular to walls 27, 29. This results in a generally rectangular transverse cross section for each tube 21.

A plurality of web walls 33 are located between edge walls 31 and extend between upper wall 27 and lower wall 29. For simplicity, the drawing shows only three web walls 33, and each is a flat member parallel with the others and perpendicular to upper and lower walls 27, 29. Normally, there would be more than three web walls 33. Web walls 33 provide strength for tube 21, preventing the high internal pressure from deforming walls 27, 29 apart from each other. Web walls 33 also define rectangular flow passages 35, of which there are four of identical dimensions shown in FIG. 2.

The cross sectional dimensions of each tube 21 are very small. In the embodiment shown, the width of each tube 21 from one edge wall 31 to the other edge wall 31 is about 0.75 inch. The height from lower wall 29 to upper wall 27 is about 0.075 inch. Each web wall 33 is approximately 0.020 inch. in thickness. The hydraulic diameter of each flow passage 35 is identical and varies depending upon the dimensions of tube 21. The hydraulic diameter is the cross sectional area of each flow path 35, multiplied by four and divided by the wetted perimeter of the flow path 35. In the preferred embodiment, the hydraulic diameter is in the range from 0.015 to 0.07 inches, and preferably about 0.050 inch.

Figure 3:
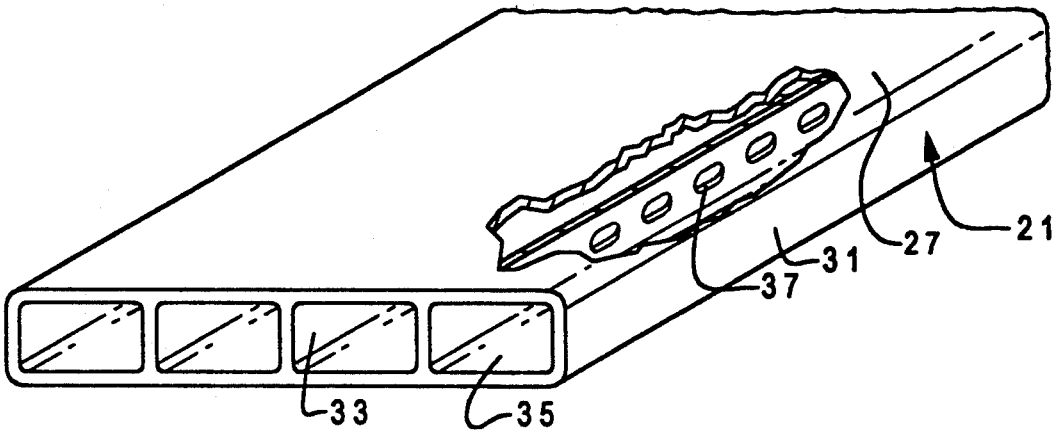
FIG. 3 is a partial perspective view of the tube of FIG. 2, with portions shown broken away.

Flow passages 35 are not discrete from each other. Rather, each communicates with at least one other flow passage 35 by means of perforations or apertures 37. Apertures 37 are spaced apart from each other and extend along each web wall 33 the full length of each tube 21, as shown in FIG. 3. Preferably apertures 37 are generally oval in shape, having a greater length in the axial direction along the length of tube 21 than height. Each aperture 37 is approximately the size of a pin hole. Compared to the height of each web wall 33, each aperture 37 is fairly large. The height of each aperture 37 may be approximately one-half the height of each web wall 33. The distance between each aperture 37 may be varied, but is preferably about 0.75 inch.

Figure 4:
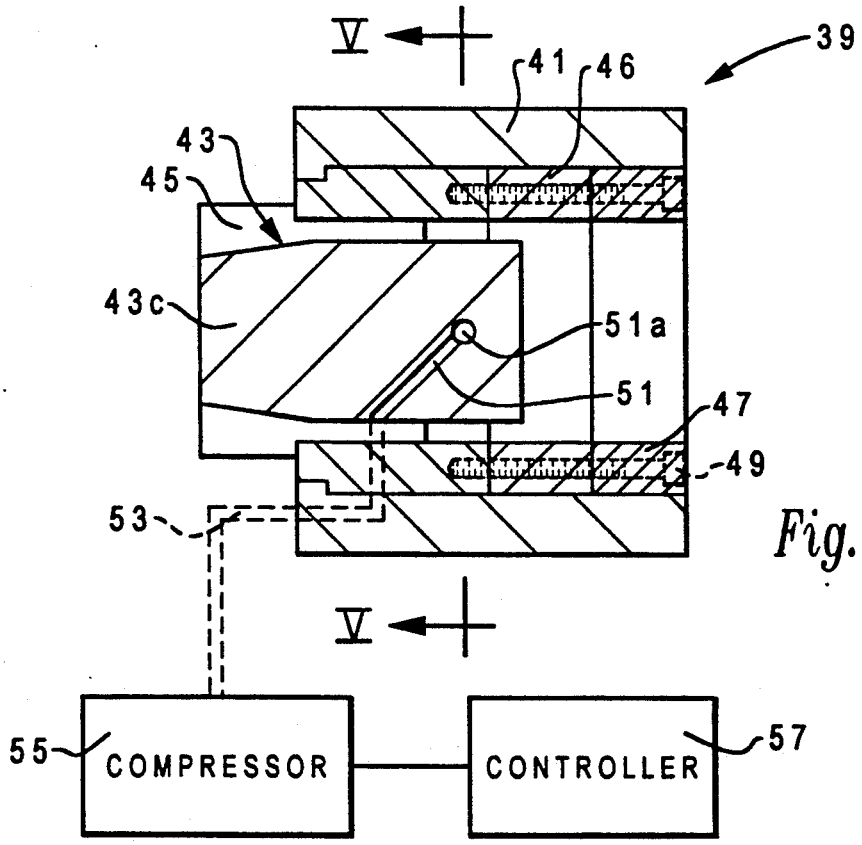
FIG. 4 is a schematic sectional view of a die for extruding the tube of FIG. 2.
Figure 5:
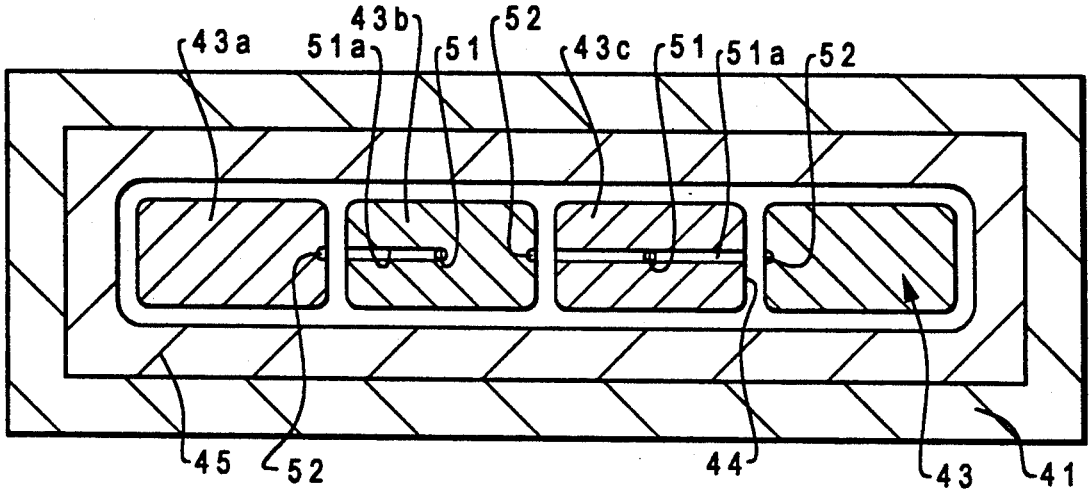
FIG. 5 is a schematic sectional view of the die of FIG. 4, taken along the line V—V.

The tubes 21 are of a heat conductive metal such as aluminum. Preferably tubes 21 are formed with an integral extrusion, including the web walls 33. FIGS. 4 and 5 illustrate schematically one method used to form the apertures 37. The extrusion die 39 includes a die ring 41 which houses a plurality of cores 43, which are four in the embodiment shown. Cores 43 include two side cores 43*a* which form the outside flow paths 35 (FIG. 2), and two intermediate cores 43*b* and 43*c*. The intermediate cores 43*b* and 43*c* form the two intermediate flow passages 35 (FIG. 2). The sides 44 of cores 43*b* and 43*c* are ID spaced from each other and adjacent cores 43*a* to create web walls 33. Each core 43 is in the shape of one of the flow paths 35, which is rectangular. In the embodiment shown, each flow path 35 is identical, thus each core 43 has identical external dimensions to the other cores 43.

A bridge 45 holds the cores 43 in place. Bridge 45 includes vertical plates that engage cores 43 and secure them to die ring 41. A cap 46 fits within die ring 41 to hold cores 43. A back-up plate 47 secures over cap 46. Back-up plate 47 secures by screws 49 to a portion of bridge 45. Extruded molten metal flows through the spaces around and between cores 43.

As shown in FIG. 5, the intermediate cores 43*b* and 43*c* each have gas or air passages 51 extending through core 43*b* and 43*c* to a lateral air passage 51*a*. The lateral passage 51*a* extends out to both sides 44 of core 43*c*. The lateral passage 51*a* of core 43*b* extends only to one side 44 of core 43*b*, as illustrated in FIG. 5. The web walls 33 are formed between the opposed sides 44 of cores 43, and thus each web wall 33 will be exposed to an air jet from one of the lateral passages 51*a*, as illustrated in FIG. 5.

As shown in FIG. 5, a relief groove 52 is formed on a side 44 of each core 43 that is opposite the outlet of lateral passage 51*a*. Relief groove 52 is a small linear recess that extends to the trailing or downstream face of the cores 43, where the solidified extruded metal discharges. Relief grooves 52 provide a discharge path for the air jet from the lateral passages 51*a*. The relief grooves 52 are located downstream of where the molten metal beings to solidify, thus should not result in a rib being formed on the web walls 31.

As shown in FIG. 4, a bridge air passage 53 communicates with the core air passages 51. Bridge air passage 53 extends through bridge 45 and is connected to a line that leads to an air compressor 55. A controller 57 will control the compressor 55 to provide pulses of air through the lateral passages 51*a*. The rate or timing between the pulses depends upon the speed of the extrusion and the desired distance between apertures 37. The duration of each pulse controls the axial elongation of each aperture 37. The pulses can be applied simultaneously to each of the lateral passages 51*a*, or they can be alternating so as to stagger the position of the various apertures 37 (FIG. 3) along the different web walls 33.

In operation, molten aluminum will be pressed through die 39 in a conventional manner. The aluminum flows around the cores 43 to form the contour shown in FIGS. 2 and 3. Controller 57 controls compressor 55 to provide bursts of air. The air pressure is directed to lateral passages 51*a* to pierce the molten metal in the web walls 33 as the metal is extruded. The pulse of air is discharge out the trailing or downstream face of the die 39 through the relief grooves 52.

The tubes 21 are cut to length and then assembled between headers 13 and 15, with the open ends of the tubes 21 being in fluid communication with the headers 13, 15. The fins 25 are placed between the tubes 21. Baffles 23 will be placed in headers 13, 15 by a variety of techniques. The condenser 11 is brazed in a furnace.

In operation, hot refrigerant vapor flows in header inlet 17, as illustrated in FIG. 1. The vapor flows enters the upper group of tubes 21, being diverted by the baffle 23 in header 13. The fluid flows in the opposite ends of a next lower group of tubes 21, being diverted by the baffle 23 in header 15. The fluid then in the open ends of the lower group of tubes 21 and out the outlet 19 as condensate. During this process, air flows past the tubes 21, due to the movement of the vehicle and/or the air conditioner fan.

Referring to FIG. 2, assuming the right side of tube 21 to be the leading edge, the air will first contact that side, then flow along the walls 27, 29 and past the left side. As the air flows along the walls 27, 29, heat is removed from the refrigerant flowing through flow passages 35. The refrigerant flowing through the flow passages 35 is in a turbulant condition. Some of the refrigerant will flow through the large number of apertures 37, with refrigerant in one flow passage 35 mixing with that of the other. The mixing of the refrigerant avoids a large differential between the temperature of the refrigerant in the flow passage 35 on the right side or upstream edge and the flow passage on the downstream or left side of the tube 21.

This invention has significant advantages. The perforations in the webs allow intermixing of the fluid flow, increasing turbulence. The perforations in the webs provide the necessary strength to avoid bursting of the tubes due to the high pressure. The method allows the perforations to be applied during the extrusion process.

While the invention has been shown in only one of its forms, it should be apparent to those skilled in the art that it is not so limited, but is susceptible to various changes without departing from the scope of the invention. For example, the tubes with perforated webs could be used in other heat exchangers, such as evaporators.

I claim:

1. In a heat exchanger having a pair of spaced apart headers, one of the headers having an inlet, the other of the headers having an outlet, a plurality of parallel tubes extending between and in fluid communication with the headers for conveying refrigerant between the headers, at least some of the tubes comprising:

substantially flat parallel upper and lower walls;

edge walls located on opposite edges of the upper and lower walls and interconnecting the upper and lower walls;

at least one web wall located between the edge walls and extending between the upper and lower walls along the length of the tube, defining a plurality of flow passages within the tube, the upper and lower walls, edge walls and web wall being an integrally formed extrusion; and a plurality of apertures extending through the web wall, the apertures being spaced apart from each other along the length of the tube for communicating fluid from each of the flow passages to another of the flow passages to enhance heat transfer.

2. The heat exchanger according to claim 1 wherein the web wall is substantially perpendicular to the upper and lower walls.

3. The heat exchanger according to claim 1 wherein the tubes are formed by an extrusion die having cores which form the flow passages, and wherein the apertures are formed by pulsing a gas through at least some of the cores.

4. The heat exchanger according to claim 1 wherein there s are a plurality of the web walls in each of the tubes.

5. An air conditioner heat exchanger, comprising in combination:

a pair of spaced apart headers, one of the headers having an inlet, the other of the headers having an outlet;

a plurality of parallel tubes extending between and in fluid communication with the headers for conveying refrigerant between the headers;

a row of fins located between each of the tubes for heat exchange with air flowing between the tubes;

each of the tubes having a plurality of web walls therein extending along the length of the tube, defining a plurality of flow passages, each of the tubes including its web walls being an integrally formed extrusion; and a plurality of apertures extending through at least some of the web walls, the apertures being spaced apart from each other along the length of the tube for communicating fluid between the flow passages to enhance heat transfer.

6. The heat exchanger according to claim 5 wherein each of the fluid flow paths has a hydraulic diameter in the range of about 0.015 to 0.07 inches, the hydraulic diameter being the cross-sectional area of the corresponding flow path multiplied by four and divided by the wetted perimeter of the corresponding flow path.

7. The heat exchanger according to claim 5 wherein the web walls are substantially parallel with each other.

8. The heat exchanger according to claim 5 wherein each of the tubes has a substantially flat upper wall and a substantially flat, parallel lower wall, and wherein the web walls are substantially parallel with each other and perpendicular to the upper and lower walls.

9. The heat exchanger according to claim 5 wherein the tubes are formed by an extrusion die having cores which form the flow passages, and wherein the apertures are formed by pulsing a gas through at least some of the cores.

10. The heat exchanger according to claim 5 wherein all of the web walls within each of the tubes have the apertures.

11. A method of making a heat exchanger tube with at least one web defining a plurality of flow passages, comprising:

providing an extrusion die with a core for each of the flow passages;

providing gas passage means through at least one of the cores; then extruding metal through the die and around the cores, while simultaneously pulsing gas through the gas passages to form holes in the web.

* * * * *